US007942573B2

(12) United States Patent
Kury

(10) Patent No.: US 7,942,573 B2
(45) Date of Patent: May 17, 2011

(54) TIMEPIECE

(75) Inventor: Patrick Kury, Langendorf (CH)

(73) Assignee: Eterna SA Fabrique d'horlogerie, Grenchen (CH)

( * ) Notice: Subject to any disclaimer, the term of this patent is extended or adjusted under 35 U.S.C. 154(b) by 120 days.

(21) Appl. No.: 12/446,384

(22) PCT Filed: Oct. 5, 2007

(86) PCT No.: PCT/EP2007/060622

§ 371 (c)(1), (2), (4) Date: Apr. 20, 2009

(87) PCT Pub. No.: WO2008/046750

PCT Pub. Date: Apr. 24, 2008

(65) Prior Publication Data

US 2010/0322039 A1 Dec. 23, 2010

(30) Foreign Application Priority Data

Oct. 20, 2006 (CH) ..... 1668/06

(51) Int. Cl.
*G04B 1/10* (2006.01)
*G04B 29/00* (2006.01)

(52) U.S. Cl. ..... 368/142; 368/318; 368/324

(58) Field of Classification Search ..... 368/142, 368/143, 140, 141, 318, 324–326
See application file for complete search history.

(56) References Cited

U.S. PATENT DOCUMENTS

| | | | | |
|---|---|---|---|---|
| 4,117,664 | A | 10/1978 | Mathys | |
| 4,132,061 | A | 1/1979 | Mathys | |
| 5,278,807 | A * | 1/1994 | Mathys | 368/140 |
| 6,478,469 | B1 * | 11/2002 | Jones | 384/461 |
| 6,603,709 | B2 * | 8/2003 | Ochoa Loaiza | 368/23 |
| 6,651,633 | B1 * | 11/2003 | Jones | 123/559.1 |
| 7,012,855 | B1 * | 3/2006 | Loaiza | 368/17 |
| 7,452,123 | B2 * | 11/2008 | Girardin et al. | 368/140 |
| 2004/0105346 | A1 * | 6/2004 | Lang | 368/80 |

FOREIGN PATENT DOCUMENTS

| | | |
|---|---|---|
| CH | 390 801 | 12/1964 |
| CH | 449 327 | 12/1967 |
| CH | 610 178 | 4/1979 |
| FR | 2 341 885 | 9/1977 |
| FR | 2 341 886 | 9/1977 |
| GB | 955499 | 4/1964 |
| JP | 11-174162 | 7/1999 |

OTHER PUBLICATIONS

International Search Report dated Jun. 30, 2008, from corresponding PCT application.

* cited by examiner

*Primary Examiner* — Sean Kayes
(74) *Attorney, Agent, or Firm* — Young & Thompson

(57) ABSTRACT

A timepiece includes a platen (10) and a barrel mounted on the platen, the barrel including: a drum (20) with a bottom and side walls; a shaft (14) extending through the drum at the center thereof and provided with pivoting elements (40, 54) on the platen; a leaf spring provided in the drum and co-operating with the shaft at one end and with the drum at the other end; and a lid (28) through which the shaft extends and closing the drum, a ratchet wheel (30) being kinematically connected to the shaft for winding the spring. According to the invention, the drum is pivoted via a first ball bearing (34) having a bushing (36) connected to the platen and another bushing (38) connected to the bottom of the drum.

9 Claims, 7 Drawing Sheets

TIMEPIECE

TECHNICAL FIELD

The present invention relates to the field of mechanical horology and more particularly concerns a timepiece whereof the barrel is arranged advantageously.

The barrel is the motor organ used in mechanical watches. It acts as an energy accumulator by being wound by the user or by an oscillating weight and progressively returning the energy it has stored to the train of the watch.

BACKGROUND OF THE INVENTION

A traditional barrel comprises:

- a barrel drum, which is a sort of cylindrical case comprising a bottom and side walls, the drum being provided with an exterior toothing to drive the train,
- a barrel-arbor pivoting between bridge and plate and provided with a hook arranged on its core,
- a strip-spring fixed by a first end to a countersink formed on the inner diameter of the side walls of the drum, and by a second end to the hook of the barrel-arbor, and
- a lid closing the drum.

The drum and the lid generally serve as a pivot for the barrel-arbor in order to stabilize the latter part. A ratchet is mounted integral with the barrel-arbor, generally square fit. It is driven by a winding device, manual or automatic, to cause the arbor to pivot and wind the barrel spring.

One skilled in the art knows that one of the main factors to improve the efficiency of a movement is the quality of the pivoting of the different elements and the weakness of the friction involved. This point is particularly essential at the level of the barrel, where the forces exerted are significant and where flaws in guiding of the arbor and drum can have non-negligible consequences for the power reserve.

Document CH 610178 proposes, with the goal of improving the pivot quality of the barrel, to mount it cantilevered using a ball bearing. The barrel-arbor is driven inside the inner ring of this bearing while the outer ring is fixed in a housing arranged in the plate. Furthermore, the drum is pivoted from the outside using runners with which it cooperates.

However, the presence of runners is particularly bothersome in terms of the bulk they create. Moreover, experience shows that the precision of the device proposed in the above-mentioned document is not very satisfactory. The present invention aims not only to offset this drawback, but also to improve the pivoting of the barrel.

BRIEF SUMMARY OF THE INVENTION

More precisely, according to the invention, the barrel drum is pivoted by a first ball bearing whereof one ring is integral with the plate and another ring is integral with the bottom of the drum.

Advantageously, the barrel-arbor is pivoted in the plate using a second ball bearing.

According to one preferred embodiment, the barrel-arbor and the drum are mounted pivoting in relation to the plate using a ball bearing comprising an intermediate ring fixed to the plate, an inner ring integral with the arbor and an outer ring integral with the bottom of the drum.

BRIEF DESCRIPTION OF THE DRAWINGS

Other details will appear more clearly upon reading the following description, done in reference to the appended drawing, in which.

DETAILED DESCRIPTION OF THE INVENTION

Figure 1:
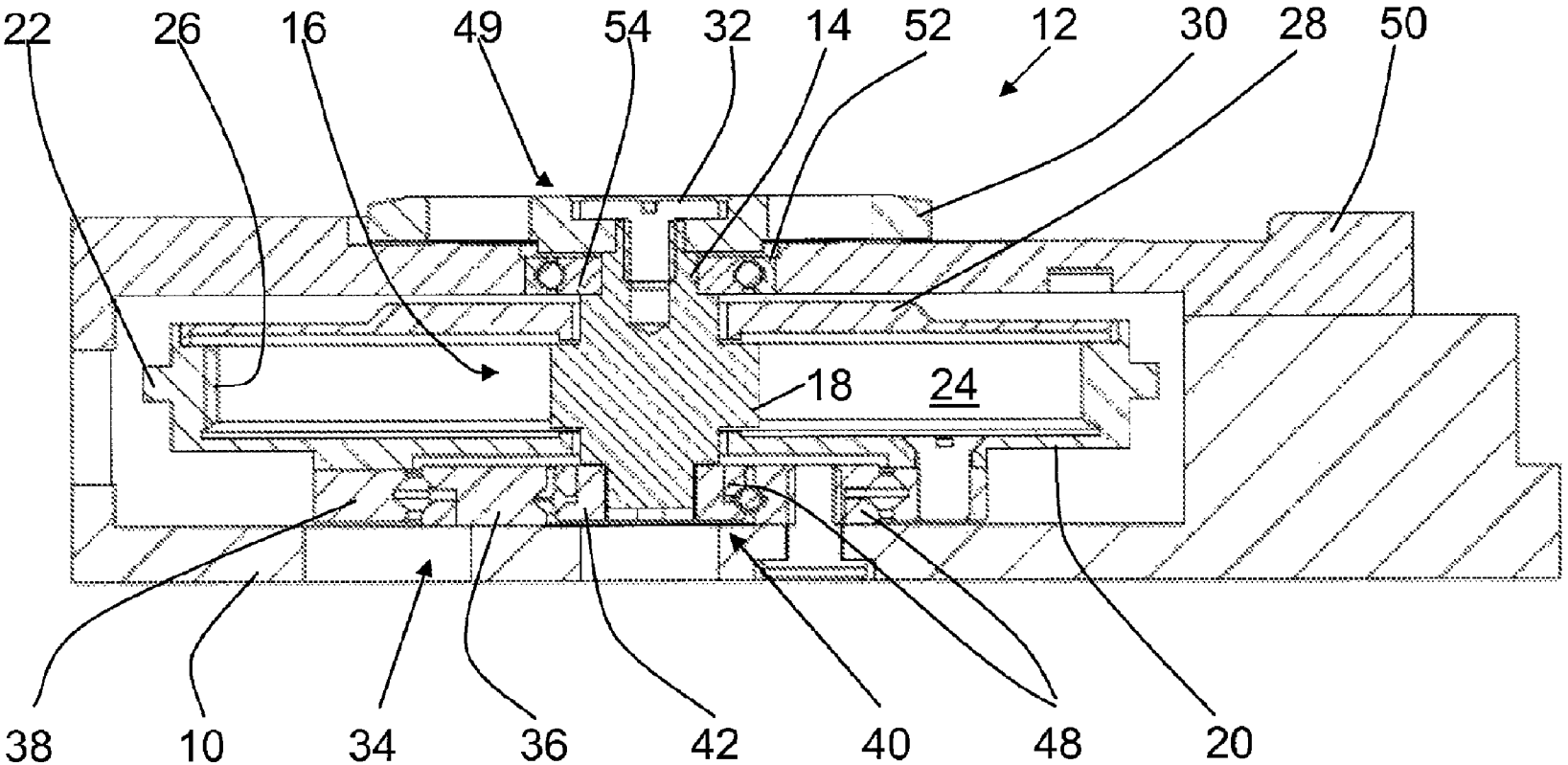
FIG. 1 is a cross-sectional view of a preferred embodiment.

We have illustrated, in FIG. 1, a plate 10 supporting the essential elements of a timepiece movement, only the energy accumulator of which is illustrated. This is formed, traditionally, of a barrel 12 mounted on the plate 10 and comprises an arbor 14 provided with means for pivoting on the plate 10. The body of the arbor 14 defines a core 16 provided with a hook 18.

The center of a drum 20 is passed through by the arbor 14 and, according to one important aspect of the present invention which will be explained in detail below, is pivoted on the plate 10. The drum is provided with an exterior toothing 22 to drive a train of a watch. It comprises a bottom located on the side of the plate and side walls forming its diameter which define a housing 24. A countersink 26 is formed inside the side walls. The drum 20 is free to pivot in relation to the arbor 14 and it can constitute a bearing for the latter part.

A strip spring, not visible in the drawing, is arranged in the housing 24, fixed by a first end to the hook 18 and by a second end to the drum, at the level of the recess 26.

A lid 28 closes the drum 20. The arbor 14 also passes through its center, and said lid 28 can constitute a bearing for the arbor 14.

A ratchet wheel 30 is mounted integral with the arbor 14, for example using a screw 32. This wheel is intended to be driven by winding means known by one skilled in the art in order to wind the strip spring.

Particularly to the invention, the drum 20 is pivoted on the plate 10 using a ball bearing 34. According to the preferred embodiment illustrated in FIG. 1, this bearing comprises:

- an intermediate ring 36 fixed to the plate, for example by screwing, and
- an outer ring 38 made integral with the bottom of the drum, for example by screwing also.

In this preferred embodiment, the means for pivoting the arbor 14 on the plate 10 are also formed by a ball bearing 40, comprising a first interior ring 42 made integral with the arbor, for example by driving in, and a second ring 44 (visible in FIGS. 5 and 6) integral with the plate 10. Advantageously, the second ring of the bearing through which the arbor pivots is formed by the intermediate ring 36.

In this way, the barrel-arbor 14 and the drum 20 are mounted pivoting in relation to the plate via a ball bearing comprising an intermediate ring 36 fixed to the plate, an inner ring 42 integral with the arbor and an outer ring 38 integral with the bottom of the drum. Advantageously, the bottom of the drum 20 can have a slight extra thickness in order to strengthen it where the screws pass. Moreover, this extra thickness makes it possible to define a slight clearance between the bottom of the barrel 12 and the other elements of the bearing, avoiding any superfluous friction.

Figures 2A, 2B:
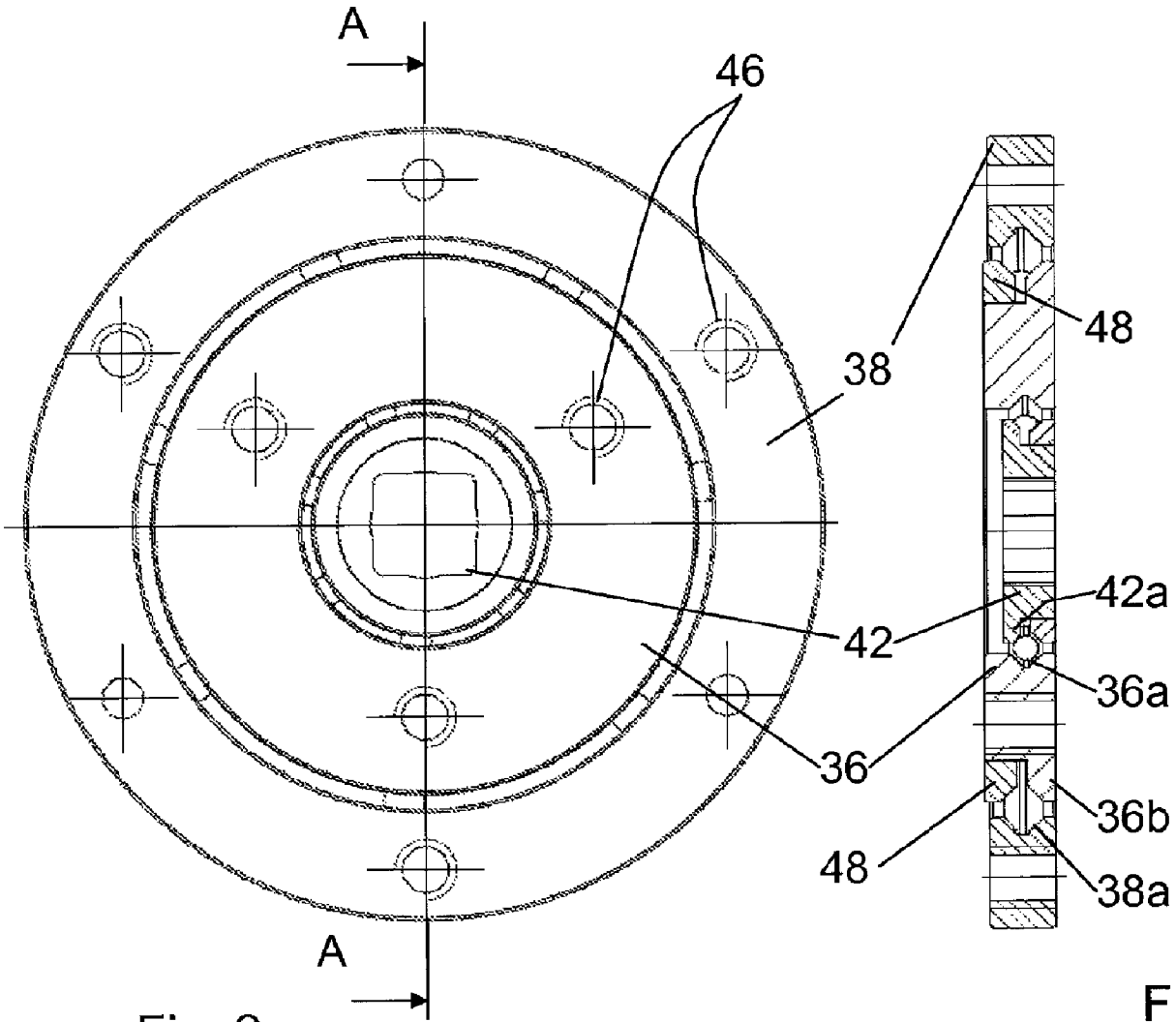
FIGS. 2*a* and 2*b* are cross-sectional and top views, respectively, of a bearing used in the embodiment of FIG. 1, and FIGS. 3 to 7 show cross-sectional views of different embodiments of the invention.

An example of bearing used is particularly visible in FIG. 2. It defines a general plane. In the following passage, the lower side of the bearing is arranged on the plate 10 side in FIG. 1 and its upper side is oriented from the side of the ratchet wheel 30.

The bearing therefore comprises an inner ring 42 provided with a circular central hole, in which the arbor 14 is intended to be placed. The inner ring 42 has a foot 42*a* extending at the lower level of its outer wall, in the general plane of the bearing. The end of this foot 42*a* is formed so as to have a bearing surface for the balls.

The intermediate ring 36 comprises a first groove 36*a* parallel to the general plane of the bearing, arranged on the inner wall, substantially in the middle of its thickness. It also has a foot 36*b* extending from the upper side of its outer wall, in the general plane of the bearing. The groove 36*a* is modeled so as to form a track, while the foot 36*b* has a bearing surface for the balls. The grooves are typically V-shaped. The ring 36 is passed through by holes 46 allowing it to be fixed to the plate 10.

The outer ring 38 comprises a second groove 38*a* parallel to the general plane of the bearing, arranged on the inner wall, substantially in the middle of its thickness. The groove 38*a* is modeled so as to form a track path for the balls, it is typically V-shaped. The outer wall is cylindrical and fits a recess with an adapted shape, arranged in the plate 10. Holes 46 extend through the ring 38, allowing the latter part to be fixed to the drum 20.

Bows 48 are arranged, respectively, on the inner ring 42 and on the intermediate ring 36, across from their foot, so as to form a track with them for the balls. The bows 48 are driven in and welded to the rings after placement of the balls, also ensuring maintenance of the assembly.

Of course, the feet and the grooves can be reversed, which is to say that the inner ring can have a groove on its outer wall, the inner wall of the intermediate ring then having a foot cooperating with a bow, etc. . . .

It is clear that, in light of the dimensions of a timepiece barrel 12, the bearings used are micro-bearings which must have maximal precision so as to guarantee perfect positioning of the pivot axes and optimal guiding of the elements in movement. These micro-bearings are, for example, produced by the company Micro Precision System AG.

Pivoting the barrel drum 20 in this way makes it possible to position it excellently and to obtain pivot conditions creating very little friction. Moreover, there is no need for peripheral guide means, which frees up all of the space around the barrel for other elements of the movement. Moreover, the fact that the intermediate ring 36, which constitutes the connecting element to the plate 10 and therefore the reference element for pivoting of the arbor 14 and the drum 20, has a relatively significant diameter, in any case more significant than if these elements were pivoted directly at the level of their pivot axis, grants the elements a better stability and greater precision in their movement. This is beneficial not only for the pivoting of the drum 20, but also for that of the arbor 14, which undergoes stresses much better than the barrel-arbors of the prior art also pivoted by a ball bearing, but arranged directly at their center. The efficiency obtained with a barrel as described above is substantially improved in relation to the barrels of the prior art.

In the illustrated embodiment, the barrel arbor 14 is not mounted cantilevered in order to improve the precision of its positioning. Its end located at the side opposite the plate is pivoted by a third ball bearing 49 arranged using an arbor bridge 50, screwed on the plate. Traditionally, this bearing 49 comprises a first outer ring 52 driven into the bridge 50 and a second inner ring 54 integral with the arbor 14. The ratchet wheel 30 tops the bearing 49 and the bridge 50 and is screwed into the arbor 14. It may also be arranged at the other end of the arbor 14.

Figure 3:
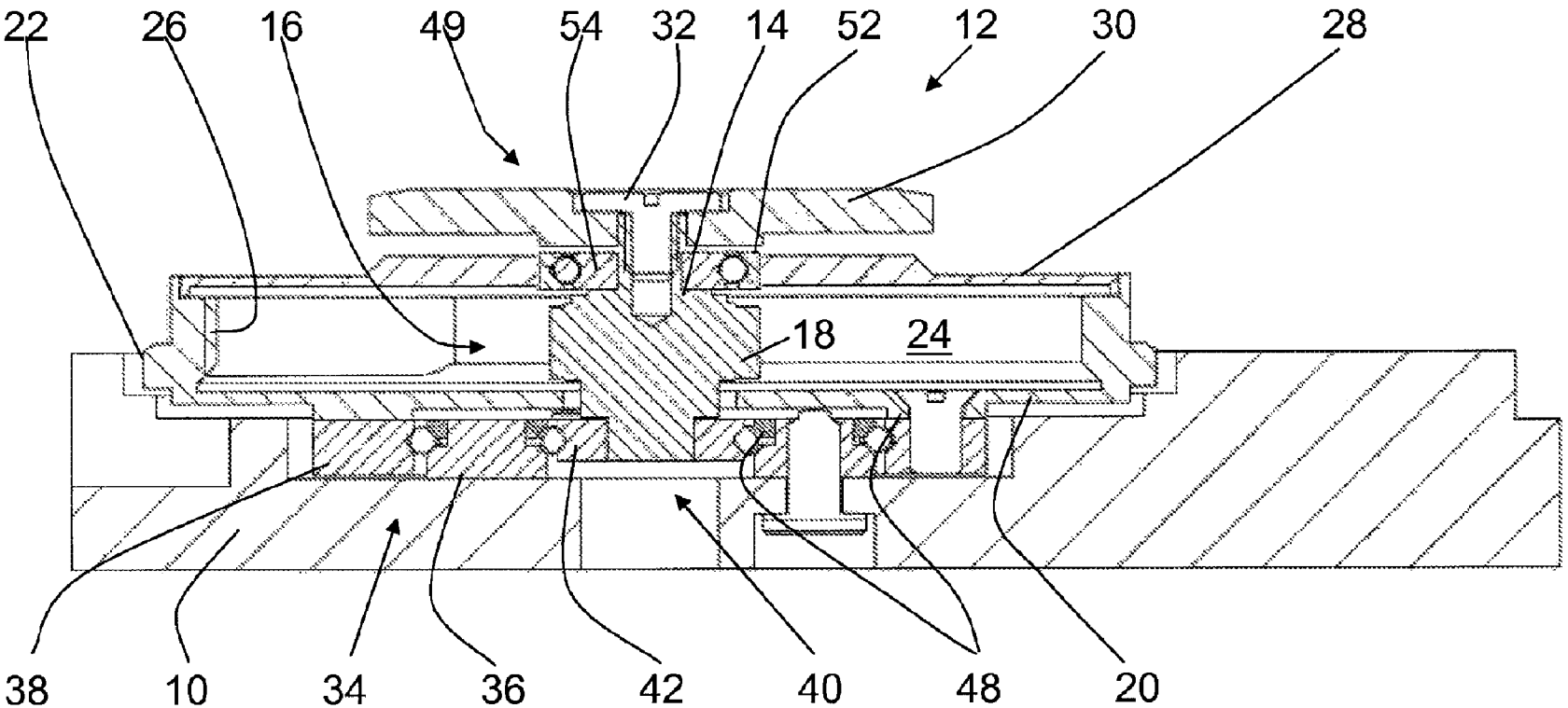

According to a first variation illustrated in FIG. 3, the third bearing 49 is directly housed in the lid of the barrel, which makes it possible to do away with the bridge 50, thereby decreasing the thickness of the assembly.

Figure 4:
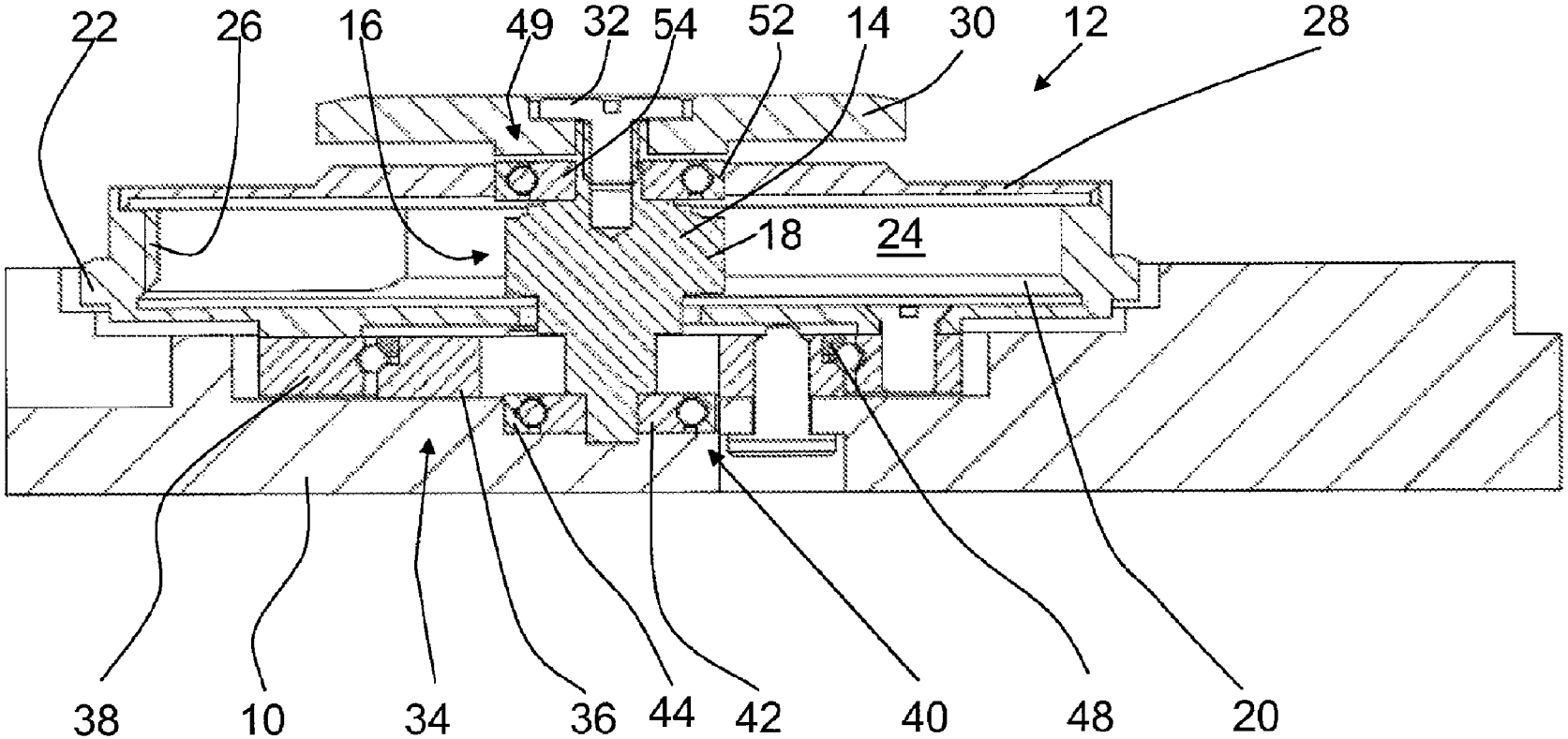
Figure 5:
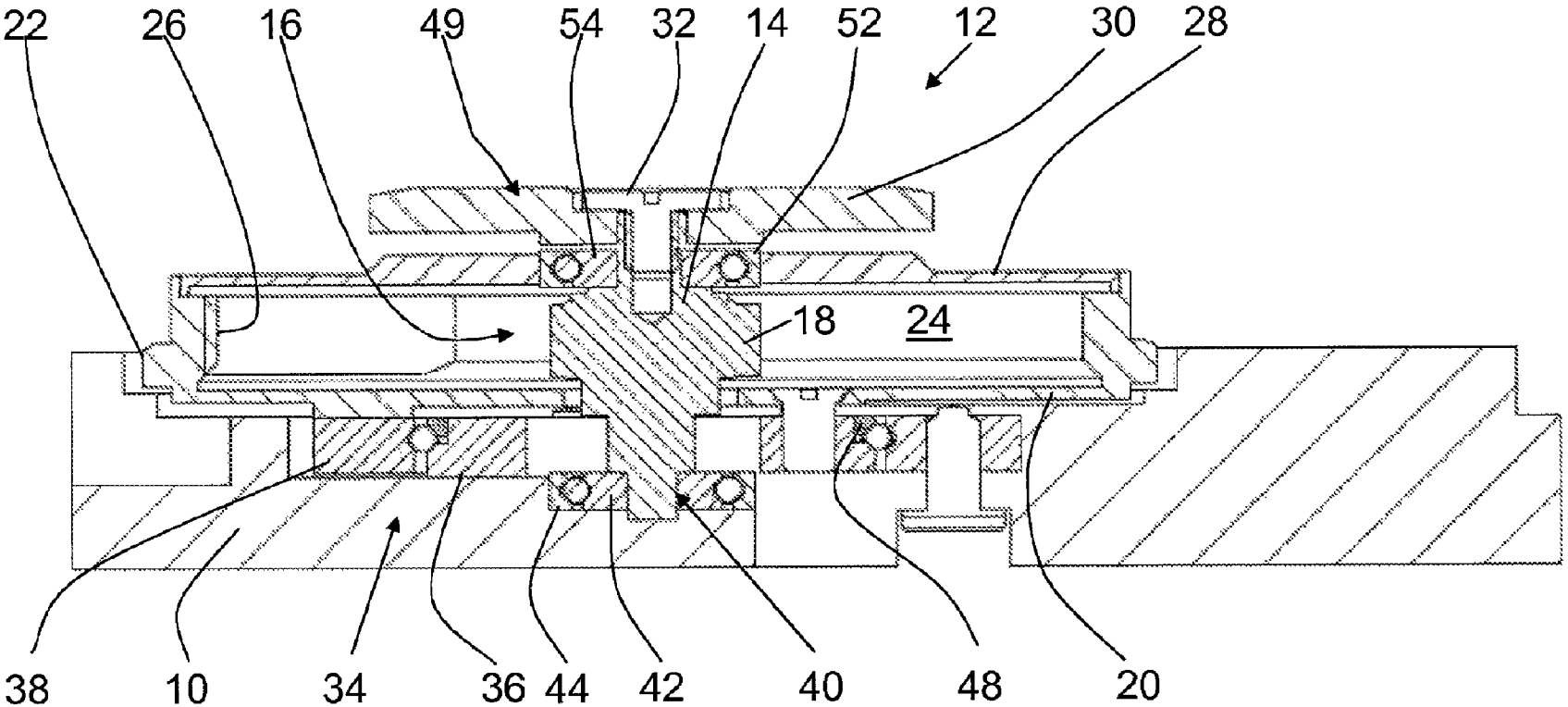
Figure 6:
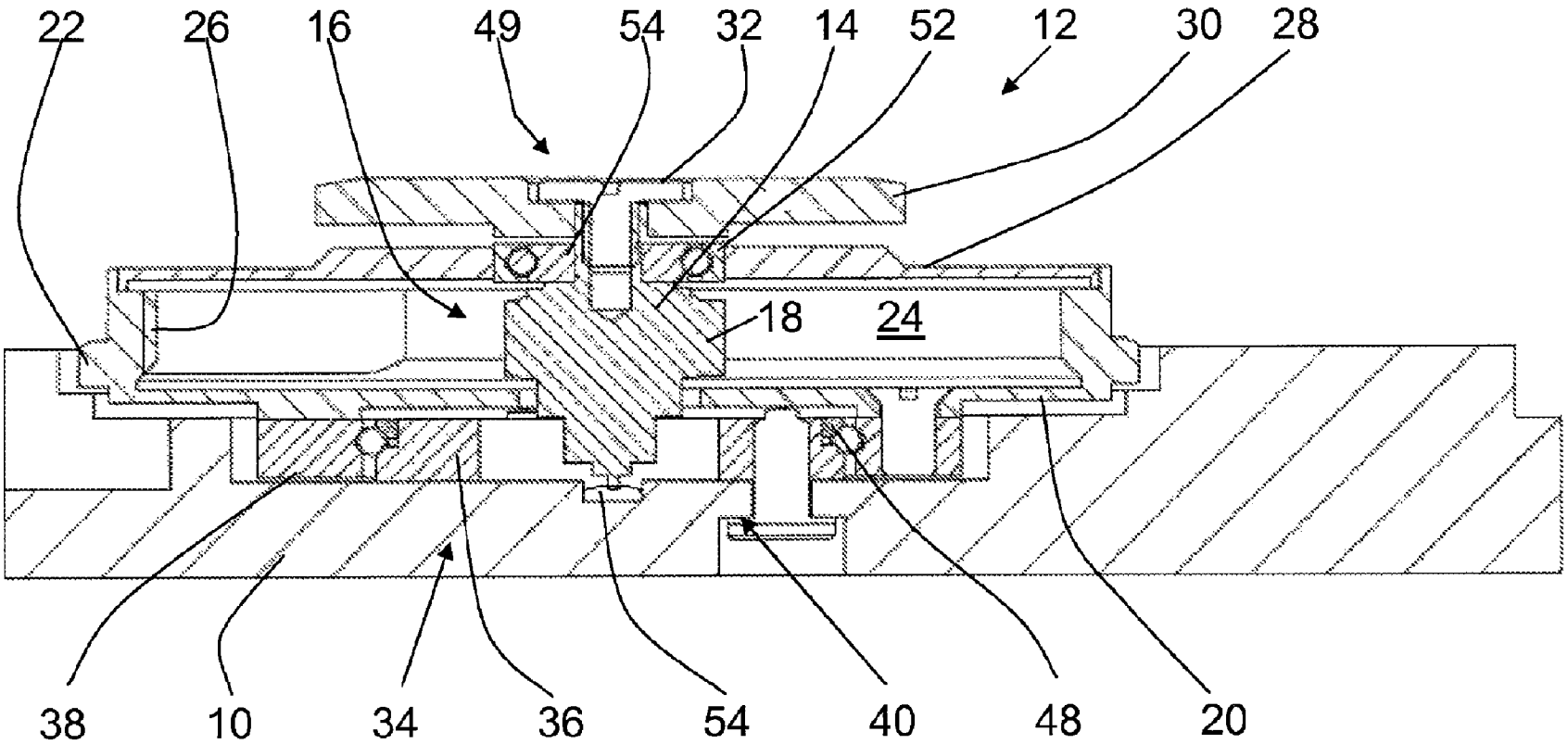

According to three other variations illustrated in FIGS. 4, 5 and 6, the means for pivoting the arbor on the plate and those for the drum on the plate are independent. The arbor is pivoted by a ball bearing 40 (FIGS. 4 and 5) or by a traditional pivot (FIG. 6), through a jewel 54. The bearing 34 through which the drum 20 is pivoted on the plate 10 can then be fixed to this by its inner ring 36 (FIG. 4) or by its outer ring 38 (FIG. 5). The bottom of the drum is fixed to the outer ring 38 (FIG. 4) or the inner ring 36 (FIG. 5) of the bearing, respectively.

Figure 7:
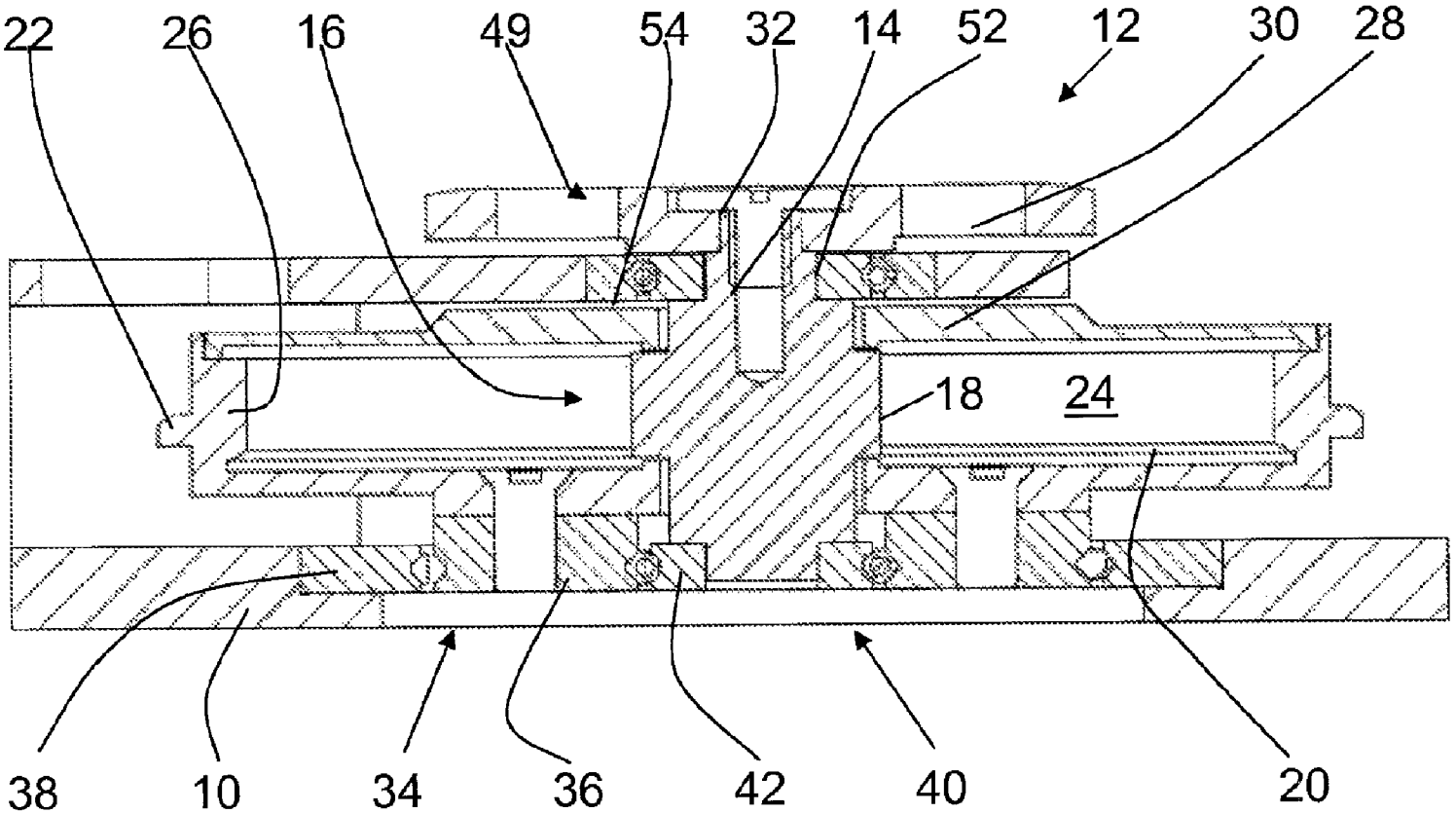

In an additional variation, illustrated in FIG. 7, the drum 20 and the arbor 14 are pivoted by a single bearing comprising three rings 36, 42 and 38, as in the preferred embodiment, but the bottom of the drum is integral with the intermediate ring 36, while the outer ring 38 is fixed to the plate 10. Advantageously, this outer ring 38 is driven into a hollow of the plate provided for this purpose.

Thus is proposed a timepiece whereof the different elements of the barrel are pivoted optimally, both in terms of guiding and in terms of the weakness of the friction. This is obtained without cluttering up the plate around the barrel and even, according to the chosen embodiment, makes it possible to avoid using a bridge for the barrel or the ratchet wheel.

The power reserve for such a barrel is improved, thanks to its efficiency, greater than that of the prior art. It is thus possible to use a less strong spring, therefore with a smaller thickness, to give the desired amplitude to the balance. The spring can therefore be wound on a larger number of turns in a same volume and therefore store more energy.

The invention claimed is:

1. A timepiece comprising a plate and a barrel mounted on the plate, said barrel comprising a drum comprising a bottom and side walls, an arbor going through the center of the drum and provided with pivoting means on the plate, a strip spring housed in the drum and cooperating by a first end with the arbor and by a second end with the drum, and a lid passed through by the arbor and closing said drum, a ratchet wheel being kinematically connected to the arbor for winding of said spring, wherein the drum is pivoted by a first ball bearing whereof one ring is integral with the plate and another ring is integral with the bottom of said drum, wherein said another ring is arranged on the side of the bottom of said drum, in direction of the plate.

2. The timepiece of claim 1, wherein the barrel-arbor is pivoted in the plate using a second ball bearing.

3. The timepiece of claim 2, wherein the barrel-arbor and the drum are mounted pivoting in relation to the plate via a ball bearing comprising an intermediate ring fixed to the plate, an inner ring integral with the arbor and an outer ring integral with the bottom of the drum.

4. The timepiece of claim 2, wherein the barrel arbor and the drum are mounted pivoting in relation to the plate through a ball bearing comprising an intermediate ring fixed to the bottom of the drum, an inner ring integral with the arbor and an outer ring integral with the plate.

5. The timepiece of claim 4, wherein said outer ring is driven into a hollow arranged in the plate.

6. The timepiece according to claim 1, characterized in that, moreover, the barrel-arbor is pivoted by a third ball bearing at its end located opposite the plate.

7. The timepiece of claim 6, wherein said third ball bearing is arranged using a bridge topping the barrel.

8. The timepiece of claim 7, wherein said ratchet wheel is arranged on the side of the bridge opposite the barrel.

9. The timepiece of claim 6, characterized in that said third ball bearing is housed in said lid.

* * * * *